United States Patent [19]

Kitrosser

[11] 4,181,421

[45] Jan. 1, 1980

[54] FILM PROCESSING

[75] Inventor: Samuel Kitrosser, Lexington, Mass.

[73] Assignee: Cordell Engineering, Inc., Everett, Mass.

[21] Appl. No.: 882,274

[22] Filed: Feb. 28, 1978

[51] Int. Cl.[2] ..... G03D 3/13

[52] U.S. Cl. ..... 354/321; 354/322; 134/64 P; 226/119; 226/171

[58] Field of Search ..... 354/312, 313, 314, 316, 354/319, 320, 321, 322; 134/64 P, 122 P; 226/119, 170, 171, 172

[56] References Cited

U.S. PATENT DOCUMENTS

| | | | |
|---|---|---|---|
| 2,048,754 | 7/1936 | Putnam | 226/171 |
| 2,927,503 | 3/1960 | Zollinger | 354/321 |
| 3,366,025 | 1/1968 | Layne | 354/322 |
| 3,418,913 | 12/1968 | Snarr | 354/312 |
| 3,492,933 | 2/1970 | Knibiehly et al. | 134/122 P |
| 3,598,037 | 8/1971 | Houston | 354/319 |
| 4,002,280 | 1/1977 | Coleman et al. | 226/171 |
| 4,034,389 | 7/1977 | Huss | 354/316 |

FOREIGN PATENT DOCUMENTS

| | | | |
|---|---|---|---|
| 1282481 | 7/1972 | United Kingdom | 226/171 |

*Primary Examiner*—L. T. Hix
*Assistant Examiner*—Alan Mathews
*Attorney, Agent, or Firm*—Charles Hieken

[57] ABSTRACT

Three or more tanks holding photographic processing solutions are arranged in series in a processing machine that transports photographic material sequentially in and out of each tank by turn-around assemblies inside each tank and by crossover assemblies between adjacent tanks. Each assembly includes a driven roller and an endless belt which holds the processed material against the periphery of the driven roller. Similar assemblies feed the first tank at the input end of the machine and deliver the material from the last tank at the exit end of the machine.

7 Claims, 2 Drawing Figures

FILM PROCESSING

BACKGROUND OF THE INVENTION

The present invention relates in general to photographic processing and more particularly concerns novel apparatus for the automatic processing of film or paper, in sheets or rolls, single-side coated or duplitized photographic material.

Automatic processing of photographic film requires that it be passed through several chemical solutions involved in a processing cycle. These solutions may include a developer, a fixer, and a wash. The chemicals may be stored in similar tanks and the film passed through one and then the other in series. One way of guiding the film in and out of the several tanks is to use a number of pairs of rollers to guide and propel the film along its path. The problems associated with this kind of automatic film processing include complexity, the maintenance of the roller systems and obtaining adequate guidance with a minimum of roller pairs so that the film does not stray from its path during the processing. Another way is to stagger the rollers. This reduces the drive power necessary but is apt to leave scratch marks on the delicate surface of certain photographic materials. Still another way is to use a system of woven, mesh or foam belts supporting the material while being transported and processed. All these methods present serious driving and maintenance problems due to their mechanical complexity and the corrosive nature of most photographic chemicals.

Examples of the prior art include the following U.S. patents:

2,889,762
3,020,818
3,027,822
3,072,310
3,156,173
3,224,356
3,366,025
3,418,913
3,492,933
3,532,048

Of these Snarr U.S. Pat. No. 3,418,913 is believed to be the most pertinent but does not disclose the belted self-threading transport assemblies according to the present invention.

For additional background reference is made to SPSE HANDBOOK OF PHOTOGRAPHIC SCIENCE AND ENGINEERING edited by Woodlief Thomas, Jr., pp. 609–17.

Accordingly, it is an important object of this invention to provide methods and means for developing film which overcomes one or more of the problems discussed above.

It is a further object of the invention to achieve one or more of the preceding objects with apparatus that is relatively simple, easily maintained, and reliable.

SUMMARY OF THE INVENTION

According to the invention there are a series of tanks with upper edges arranged so that they are essentially parallel to each other. A number of belted self-threading transport assemblies are mounted along the upper edge of the tanks, and each tank holds an insert with a belted self-threading transport assembly located near the bottom of the tank. A travel path is defined by the material conveyed by the transport assemblies. A first belted self-threading transport assembly located at the input or head end of the machine conveys the photographic material from the loading table around the first transport drive roller down into the first tank in the direction of the entry nip of a second assembly and around the second drive roller at the bottom of the first tank for immersal in a first chemical solution therein. This turn-around assembly directs the material up out of the first tank into the nip of the cross-over assembly between the first and second tanks. The in and out conveying of the material is repeated in each following tank of the machine. An exit assembly conveys the material into the drying section of the machine.

According to the invention each transport assembly comprises a driving roller and a cooperating idling belt mounted on its own shafts and rollers. The belt contacts a section of the periphery of the roller forming an entry nip and an exit nip. The supporting rollers and shafts are arranged so that the belt is never trapped in a nip between two adjacent rollers, and the belt is moved by friction between its surface and the surface of a driving roller. The belt and the driving roller will seize the leading edge of material and will turn the material around the driving roller and expel the material out the exit nip. The turn-around angle will depend on the angular wrap of the belt around the drive roller. Angles of 90° and 180° can be readily achieved with structures relatively free from complexity. Material guiding plates are located in the interior of the tanks to prevent a folded or a damaged leading edge from missing the nip of a belt and roller assembly. All the driving rollers are connected to a drive motor located outside the tank assembly.

DETAILED DESCRIPTION OF A PREFERRED EMBODIMENT

Figure 1:
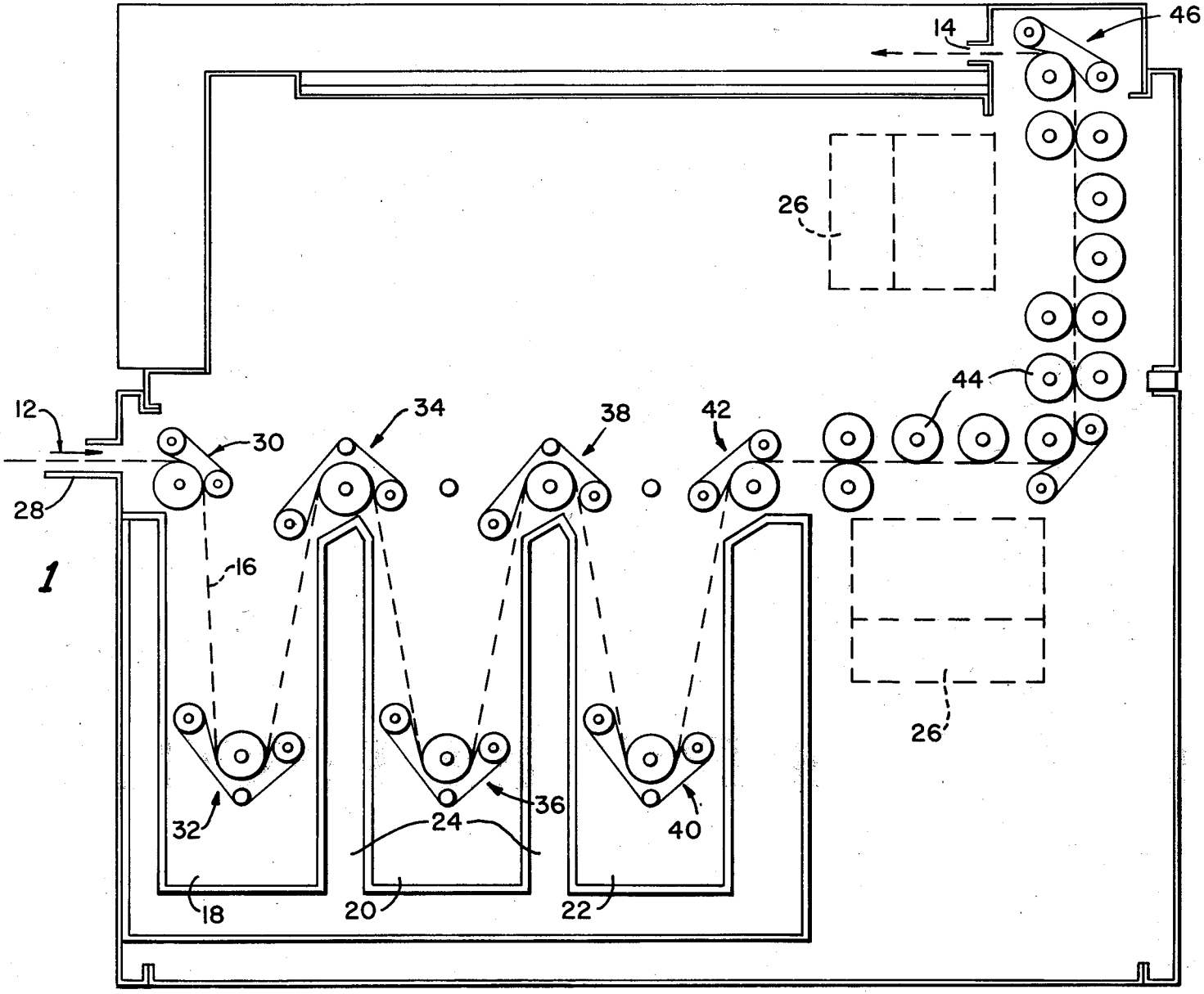
FIG. 1 is a diagrammatic representation of a side view of an automatic film processor embodying the invention.

With reference now to the drawing and more particularly FIG. 1 thereof, there is shown an automatic processing unit having an input slot 12 for receiving film sheets to be developed and an output slot 14 for delivering developed film sheets. The path that sheet film takes as it proceeds through the unit is designated by dotted line 16.

The major components of the film processing unit are three liquid holding tanks including a tank 18 for holding developer, a tank 20 for holding the fixer and a tank 22 for holding a washing liquid. The walls 24 of the three tanks are hollow and filled with water to form a water jacket for the tanks. The unit also includes two fan units 26 for drying the film which has completed processing.

Following the film path through the apparatus shown in FIG. 1, it can be further seen that the film is placed on input table 28 before input slot 12. It is then inserted through input slot 12 and is guided and propelled by the first belted self-threading transport assembly 30 located at the first upper edge of tank 18. The material 16 then moves toward belted self-threading transport assembly 32 located in the interior of tank 18. After reversing direction, the material 16 moves to a belted self-threading transport assembly 34 located just above and between developer tank 18 and fixer tank 20. Again the material reverses direction and proceeds into the interior of fixer tank 20 and the belted self-threading transport assembly 36. Reversing direction again the material moves up to belted self-threading transport assembly 38 and down to belted self-threading assembly 40 in the wash tank 22 and then out via belted self-threading assembly 42.

Leaving roller system 42 the film path continues through and by rollers 44, passing thereby through dryers 26. An exit roller system 46 guides and propels the film through output slot 14.

Figure 2:
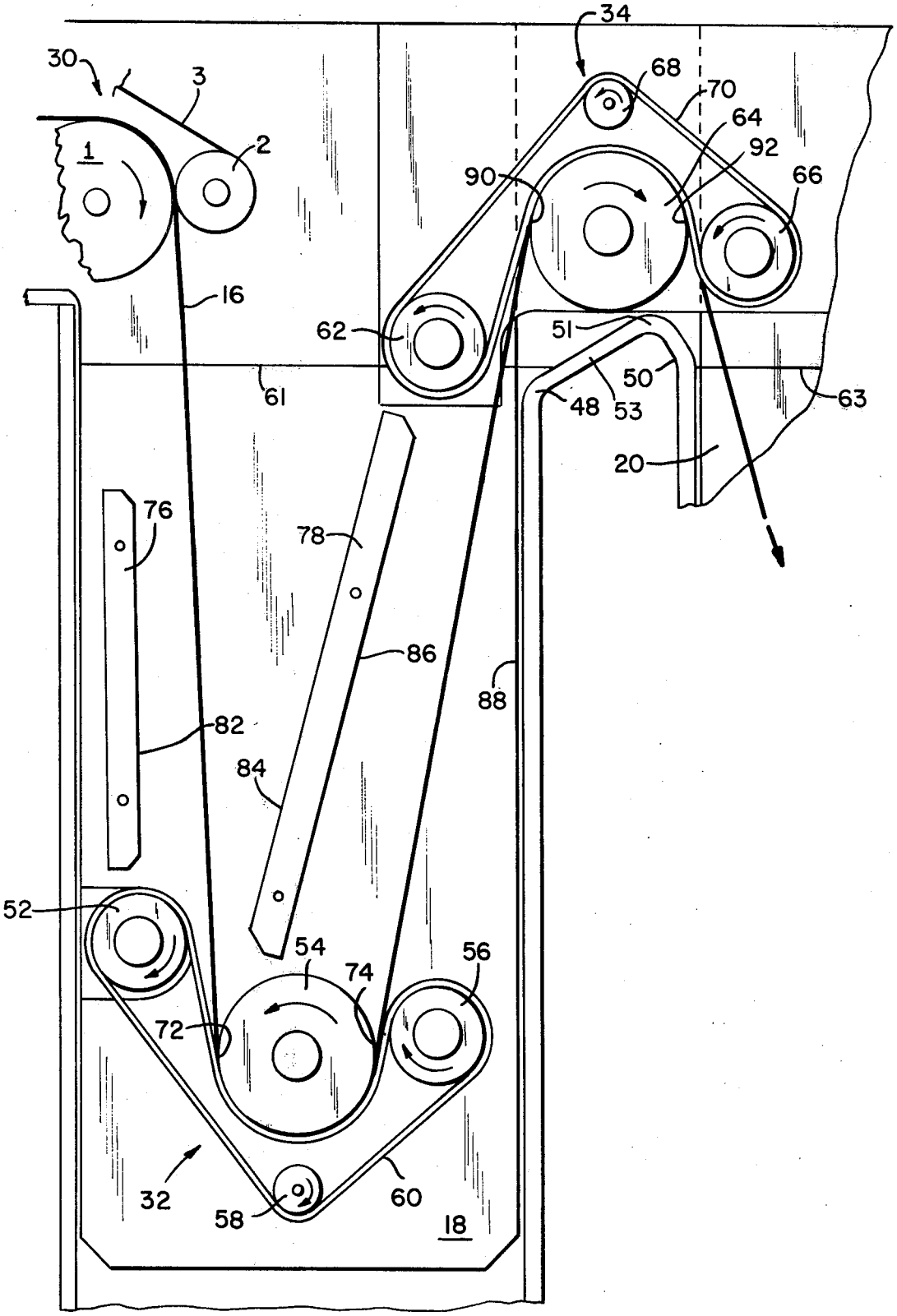
FIG. 2 is an elevation, cross-sectional view of a tank included in the apparatus of FIG. 1.

Referring now to FIG. 2 there is shown developer tank 18, with an upper edge 48 and a portion of the adjacent fixer tank 20 having an upper edge 50. Also left upper edge of developer tank 18 is shown. Above this edge is shown a section of transport assembly 30, comprising driving roller 1, belt 3 and belt roller 2. Located in the interior of developer tank 18 is transport assembly 32. This assembly includes driving roller 54 and belt 60 with its system of rollers 52, 58 and 56. Belt rollers 52 and 56 are spaced away from drive roller 54 so as to provide free running of belt 60 without pinching. Assembly 34 just above the edge 48 of tank 18 and edge 50 of tank 20 is similar to transport assembly 32. Belt roller 62 is located low enough so that it continuously contacts the surface of the developer but roller 66 is definitely above the level of the fixer so that no solution contamination can occur. The belt surface is maintained wet and clean of dry chemicals. Transport assemblies 32 and 34 are power driven by driving rollers 54 and 64, respectively, connected to the main drive (not shown) of the machine. A belt in a crossover assembly traverses a path below the fluid level line 61 of one tank from which the material exits and above the fluid level line 63 of the adjacent tank to which the material enters.

The center of driving roller 64 is to the left of peak 51 so that fluid dripping from roller 64 is guided by sloping wall 53 back into the developer tank. Belt 70 and roller 64 coact to provide squeegeeing action as the film material enters the entry nip with the released developer being guided back into the developer tank 18.

Returning to a consideration of roller system 32 it can be seen that endless belt 60 is in contact with direction reversal roller 54 over substantially the lower half of the roller. Film passing along film path 16, then, passes between direction reversal roller 54 and endless belt 60 at a film entry 72 and leaves endless belt 60 and roller 54 at film exit 74.

Film guides 76, 78 and 80 are located in developer tank

Film guide 76 includes surface 82 and film guide 78 includes surface 84. Both surfaces are oriented to guide film passing along film path 16 to film entry 72. Film guide 78 also includes surface 86 and the tank wall includes surface 88, both oriented to guide film passing along film path 16 to the corresponding film entry 90 for roller system 34. Roller system 34 also has film exit 92.

Guides 76 and 84 are oriented so that the edges facing the film path are in planes passing substantially through the axes of rollers 52 and 62, respectively, to insure that the leading edge of the material being processed enters the entry nip of turnaround assembly 32 and crossover assembly 34, respectively.

During the passage of film along film path 16, it can be seen that film passed down into developer tank 18 by guide rollers 30 will proceed without the assistance of other guide rollers to film entry 72. The surfaces 82 and 84 of film guides 76 and 78 help to guide film towards film entry 72. The location of entry roller 52, namely, spaced away from film entry 72 and spaced from film path 16, in connection with the movements of endless belt 60 from entry roller 52 toward direction reversal roller 54 (in the direction of film movement), helps capture the film for film entry 72. After the direction of film passing around roller 54 is essentially reversed it moves from film exit 74 past the guiding surfaces 86 and 88 of film guide 78 and the wall to a similar configuration of entry roller 62 and direction reversal roller 64 of roller system 34 above the edges 48 and 50 of tanks 18 and 20. There the film is once again reversed and moves past roller 64 at film exit 92.

It can be seen then that single roller systems located at the bottom and top of adjacent tanks adequately guide and propel film along the desired film path 16 through the processing unit.

Various material known in the art may be used in practicing the invention. The belts such as 70 may be elastomers of the polyurethane family or other synthetic and natural rubber materials. A preferred material is EPDM material and is typically slightly wider than 14 inches for accommodating 14-inch wide film sheets. A typical transport rate is 5 feet per minute for satisfactory developing of typical X-ray sheet film; however, slower or faster rates may be used within the principles of the invention.

The invention has a number of advantages. When the diameters of the different driving rollers are the same as in the preferred arrangement, the web speed is the same, independent of the belt thickness. The driving roller and idling belts trap the web between smooth surfaces so as to minimize damage to the web while being processed to help insure that the developed image is that photographically induced substantially free from mechanically impressed distortions introduced while transporting the web to be processed. Furthermore, the arrangement according to the invention treats both sides of the web substantially equally, a feature especially useful in processing duplitized types of photographic materials coated on both sides of the base material.

There has been described novel apparatus and techniques for processing a wide variety of photographic materials with apparatus that is relatively simple and efficient. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus herein disclosed and limited solely by the spirit and scope of the appended claims.

What is claimed is:

1. Photographic processing apparatus comprising, at least first and second tanks in series with upper edges arranged so that the upper edge of said first tank is adjacent to an upper edge of said second tank, a series of belted self-threading transport means located at the upper edges of each of said tanks for guiding material to be processed into and from said tanks, and first and second belted self-threading transport means at the bottom of said first and second tanks respectively for accepting downwardly moving material to be processed and turning said material around and directing it upward to the next in said series of belted self-threading transport means, each of said belted self-threading transport means comprising, first driving roller means for providing driving power, and an endless idling belt in contact with said driving roller and surrounding at least first, second and third contacting spaced idling rollers each spaced from said driving roller by a distance greater than the belt thickness so that the belt is free of being pinched between said rollers, said first driving roller means being outside said endless idling belt.

2. Photographic processing apparatus in accordance with claim 1 wherein said first idling roller is spaced further from said first driving roller means than the spacing between said third idling roller and said first driving roller means for defining entry and exit nips respectively.

3. Photographic processing apparatus in accordance with claim 2 and further comprising, guide means in said tanks for directing film material to be processed toward an associated entry nip.

4. Photographic processing apparatus in accordance with claim 3 wherein the plane of said guide means passes through the axis of said first idler roller.

5. Photographic processing apparatus in accordance with claim 2 wherein each tank has a level line to which the respective tank is filled with a chemical solution and means for supporting the belted self-threading transport means between said first and second tanks with the first of said idler rollers having a portion thereof below the first tank liquid level line and the remaining rollers associated therewith being above the second tank liquid level line.

6. Photographic processing apparatus in accordance with claim 5 and further comprising a wall interconnecting said first and second tanks and sloping downwardly from said second tank to said first tank for guiding solution dripping from the latter self-threading transporting mechanism into the first tank.

7. Photographic processing apparatus in accordance with claim 6 wherein the driving roller means of the latter belted self-threading transport mechanism has its axis above said sloping wall.

* * * * *